US009229366B2

(12) United States Patent
Shibata

(10) Patent No.: US 9,229,366 B2
(45) Date of Patent: Jan. 5, 2016

(54) DEVELOPER STORAGE CONTAINER AND IMAGE FORMING APPARATUS PROVIDED WITH SAME

(71) Applicant: KYOCERA Document Solutions Inc., Osaka-shi, Osaka (JP)

(72) Inventor: Naoki Shibata, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/580,935

(22) Filed: Dec. 23, 2014

(65) Prior Publication Data

US 2015/0185660 A1 Jul. 2, 2015

(30) Foreign Application Priority Data

Dec. 27, 2013 (JP) ..... 2013-270616

(51) Int. Cl.
*G03G 15/08* (2006.01)

(52) U.S. Cl.
CPC ..... *G03G 15/0865* (2013.01); *G03G 15/0877* (2013.01); *G03G 15/0875* (2013.01); *G03G 2215/06* (2013.01); *G03G 2215/066* (2013.01); *G03G 2215/068* (2013.01); *G03G 2215/0668* (2013.01); *G03G 2215/0685* (2013.01)

(58) Field of Classification Search
CPC ..... G03G 15/0865; G03G 15/0875; G03G 2215/06; G03G 2215/066; G03G 2215/0668; G03G 2215/068; G03G 2215/0685; G03G 15/0877
See application file for complete search history.

(56) References Cited

U.S. PATENT DOCUMENTS

| | | | | |
|---|---|---|---|---|
| 5,084,734 | A | 1/1992 | Yoshino et al. | |
| 5,208,637 | A * | 5/1993 | Landa | 399/120 |
| 2014/0079441 | A1 * | 3/2014 | Abler et al. | 399/262 |

FOREIGN PATENT DOCUMENTS

| | | |
|---|---|---|
| EP | 1 076 271 | 2/2001 |
| JP | 2-91253 | 7/1990 |
| JP | 5-107918 | 4/1993 |
| JP | 2001-92230 | 4/2001 |
| JP | 2006-145905 | 6/2006 |
| JP | 2007-212766 | 8/2007 |

(Continued)

OTHER PUBLICATIONS

Japanese Office Action of Feb. 25, 2014.

(Continued)

*Primary Examiner* — Ryan Walsh
(74) *Attorney, Agent, or Firm* — Gerald E. Hespos; Michael J. Porco; Matthew T. Hespos

(57) ABSTRACT

A developer storage container includes a container main body, a developer discharge port, a moving shaft, a moving plate, a guide portion and an elastic member. The container main body includes a wall defining an internal storing space. The developer discharge port is arranged at a predetermined position of the container main body. The moving shaft is arranged to extend in a first direction in the internal space. The moving plate moves in the first direction along the moving shaft in the internal space and conveys the developer toward the developer discharge port. The guide portion guides a movement of the moving plate in the first direction while maintaining the posture of the moving plate. The elastic member is attached to the moving plate and slides in contact with an inner surface of the wall of the container main body when the moving plate moves in the first direction.

14 Claims, 11 Drawing Sheets

(56) References Cited

FOREIGN PATENT DOCUMENTS

| | | |
|---|---|---|
| JP | 2008-129336 | 6/2008 |
| JP | 2008-292729 | 12/2008 |
| JP | 2012-155274 | 8/2012 |

OTHER PUBLICATIONS

Japanese Patent Appl. No. 2014-118444—Office Action issued Mar. 3, 2015.

* cited by examiner

DEVELOPER STORAGE CONTAINER AND IMAGE FORMING APPARATUS PROVIDED WITH SAME

INCORPORATION BY REFERENCE

This application is based on Japanese Patent Application No. 2013-270616 filed with the Japan Patent Office on Dec. 27, 2013, the contents of which are hereby incorporated by reference.

BACKGROUND

The present disclosure relates to a developer storage container for storing a developer and an image forming apparatus provided with the same.

In an image forming apparatus for forming an image on a sheet using toner (developer), a toner container for supplying the toner to a developing device is assembled. In terms of effectively using a toner material, it is desirable to exchange the toner container with a new one after the toner stored in the toner container is completely used up. However, it is difficult to use up the toner since the toner adheres to an inner peripheral wall of the container and stays in a corner part in the container.

A technology for arranging a partition plate movable toward a discharge port in a toner container is known as a conventional technology. The partition plate is biased in a direction to move the toner toward the discharge port by a spring.

SUMMARY

A developer storage container according to one aspect of the present disclosure includes a container main body, a developer discharge port, a moving shaft, a moving plate, a guide portion and an elastic member.

The container main body includes a wall defining an internal space for storing a developer. The developer discharge port is arranged at a predetermined position of the container main body and allows the internal space to communicate with outside through the wall. The moving shaft is arranged to extend in a first direction in the internal space. The moving plate moves in the first direction along the moving shaft in the internal space and conveys the developer toward the developer discharge port. The guide portion guides a movement of the moving plate in the first direction while maintaining the posture of the moving plate. The elastic member is attached to the moving plate and slides in contact with an inner surface of the wall of the container main body when the moving plate moves in the first direction.

Further, an image forming apparatus according to another aspect of the present disclosure includes the above developer storage container, an image carrier which carries an electrostatic latent image and a developer image, a developing device to which the developer is supplied from the developer storage container and which supplies the developer to the image carrier, and a transfer unit which transfers the developer image from the image carrier to a sheet.

DETAILED DESCRIPTION

Figure 1:
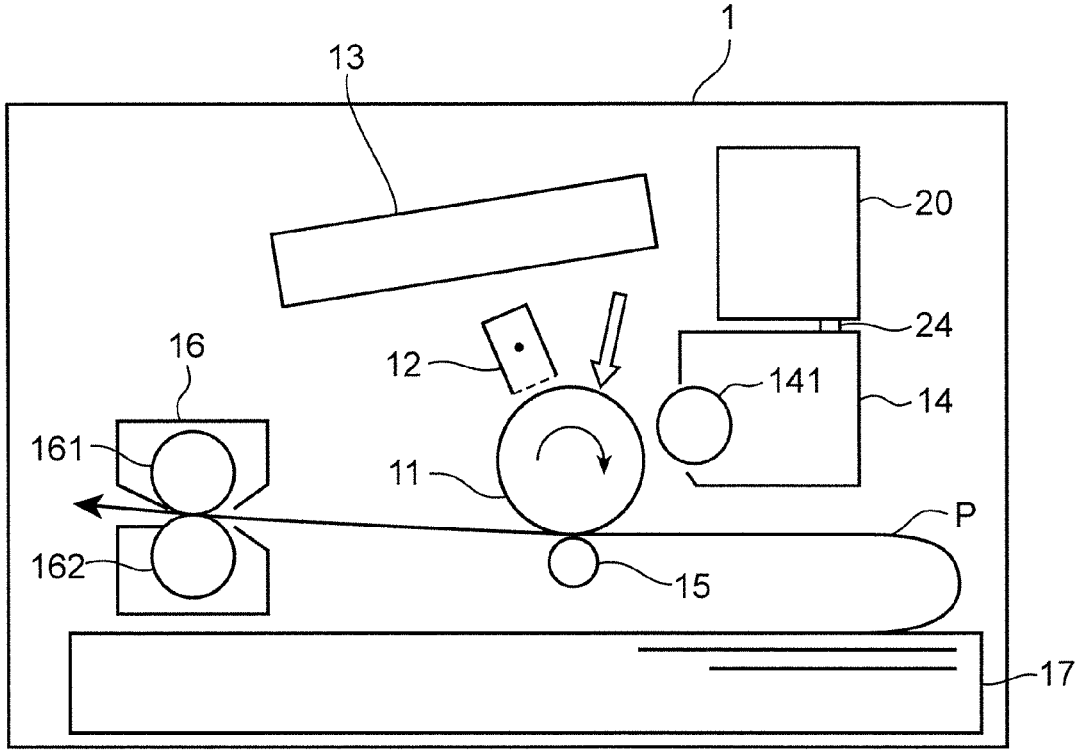
FIG. 1 is a schematic sectional view showing the internal structure of an image forming apparatus according to one embodiment of the present disclosure.

Hereinafter, embodiments of the present disclosure are described in detail based on the drawings. FIG. 1 is a schematic sectional view showing the internal structure of an image forming apparatus 1 according to one embodiment of the present disclosure. The image forming apparatus 1 includes a photoconductive drum 11 (image carrier), a charger 12, an optical scanning device 13, a developing device 14, a transfer roller 15 (transfer unit), a fixing device 16, a sheet cassette 17 and a toner container 20 (developer storage container).

The photoconductive drum 11 is a cylindrical member and carries an electrostatic latent image and a toner image (developer image) on a peripheral surface thereof. The photoconductive drum 11 is rotated in a clockwise direction in FIG. 1 upon receiving a drive force from an unillustrated motor. The charger 12 substantially uniformly charges the peripheral surface of the photoconductive drum 11. The optical scanning device 13 forms an electrostatic latent image on the peripheral surface of the photoconductive drum 11. The optical scanning device 13 includes a light source such as a laser diode, a deflector, a scanning lens, an optical element and the like and irradiates laser light corresponding to image data to the peripheral surface of the photoconductive drum 11 substantially uniformly charged by the charger 12.

The developing device 14 develops the electrostatic latent image by supplying toner to the peripheral surface of the photoconductive drum 11. The developing device 14 includes a developing roller 141 for carrying the toner and a screw (not shown) for agitating and conveying the toner. The toner container 20 supplies the toner to this developing device 14. The toner container 20 includes a toner discharge port 24 (developer discharge port) communicating with a housing of the developing device 14 and supplies the toner into the developing device 14 through the toner discharge port 24 according to the consumption of the toner.

The transfer roller 15 is arranged to face the photoconductive drum 11 from below and forms a transfer nip portion together with the photoconductive drum 11. A transfer bias is given to the transfer roller 15 to transfer a toner image formed on the photoconductive drum 11 to a sheet. The fixing device 16 includes a fixing roller 161 with a built-in heater and a pressure roller 162 arranged to face the fixing roller 160. The fixing device 16 fixes a toner image to a sheet by heating and pressing the sheet having the toner image transferred thereto. The sheet cassette 17 stores a multitude of sheets to be used for image formation.

Next, an image forming operation of the image forming apparatus 1 is briefly described. First, the peripheral surface of the photoconductive drum 11 is substantially uniformly charged by the charger 12. The charged peripheral surface is exposed to light by the optical scanning device 13, whereby an electrostatic latent image of an image to be transferred to a sheet is formed on the peripheral surface of the photoconductive drum 11. This electrostatic latent image is visualized as a toner image by supplying the toner from the developing roller 141 of the developing device 14 to the peripheral surface of the photoconductive drum 11. On the other hand, a sheet is fed to a conveyance path P from the sheet cassette 17. The toner image is transferred to this sheet by the passage of the sheet through the transfer nip portion. After this transfer operation is performed, the sheet is conveyed to the fixing device 16 and the toner image is fixed to the sheet.

Figure 2:
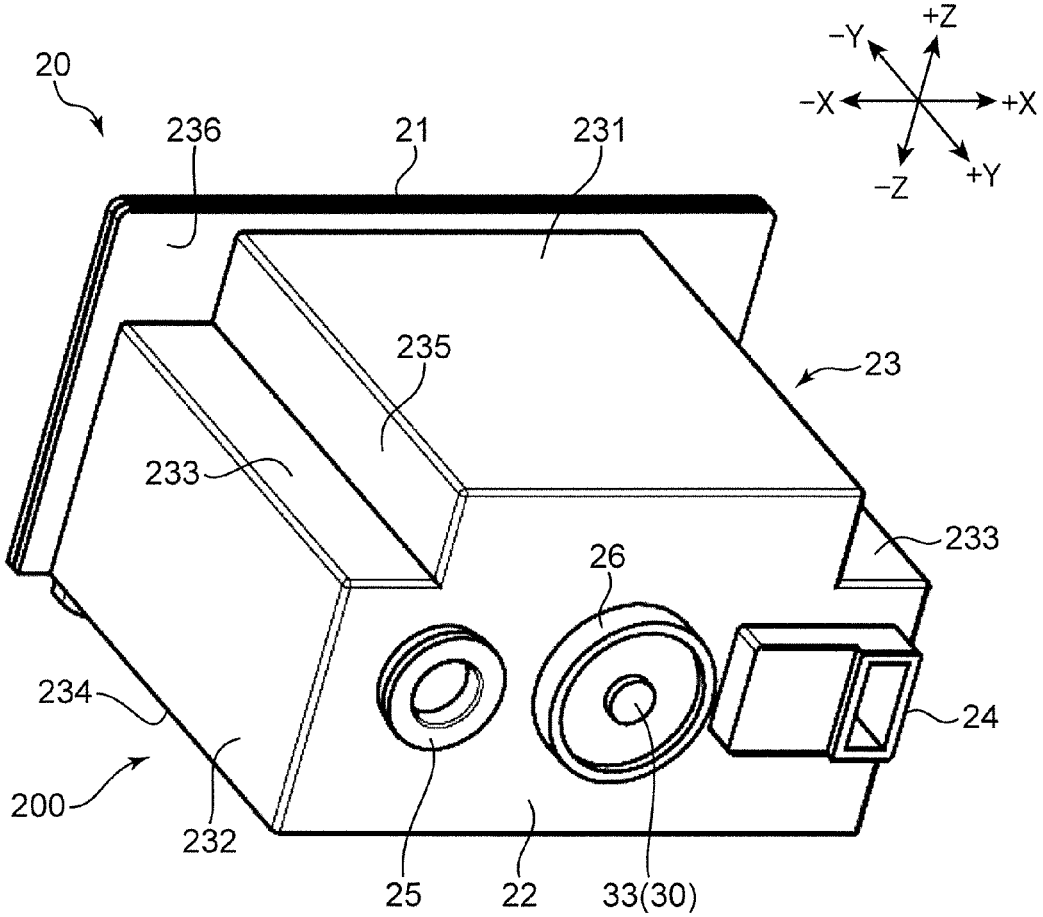
FIG. 2 is a perspective view of a toner container according to a first embodiment of the present disclosure.
Figure 3:
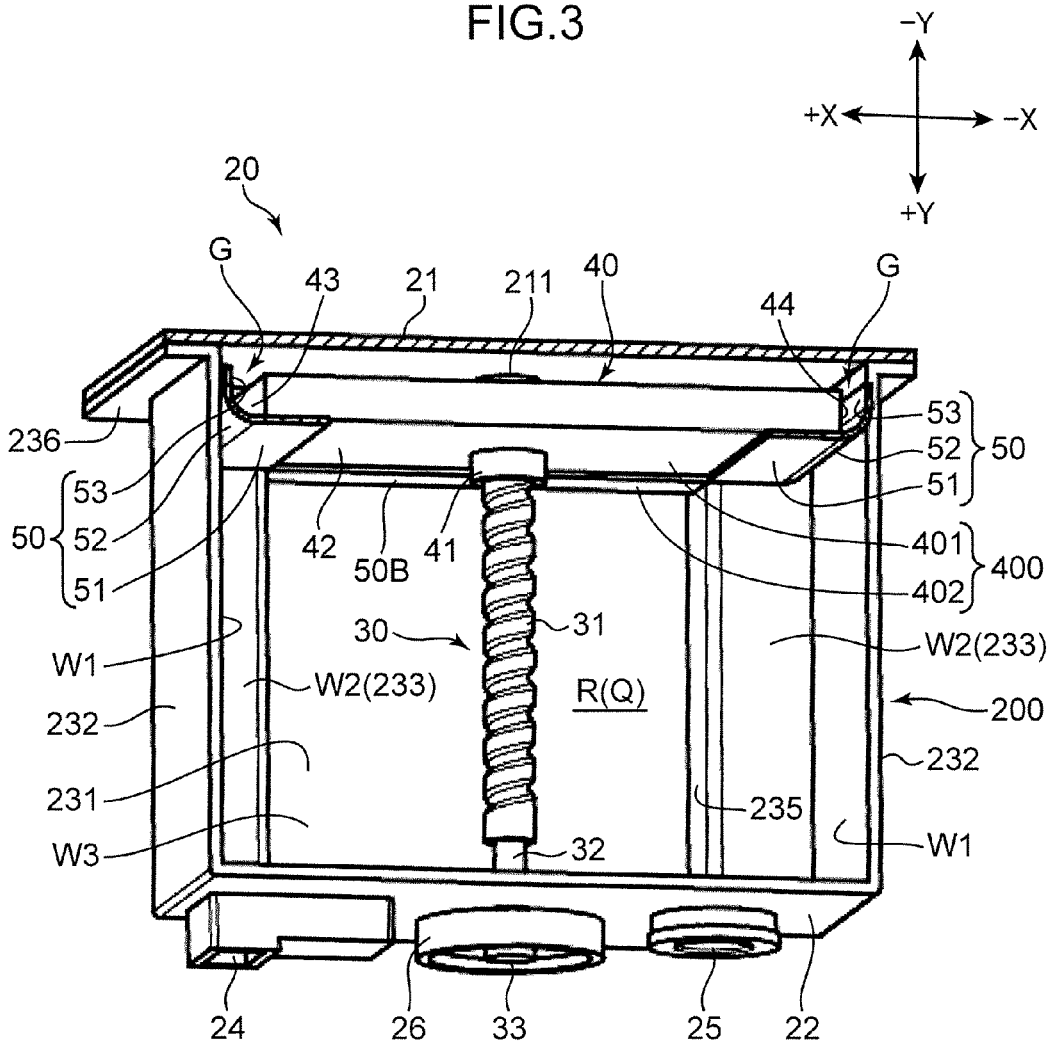
FIG. 3 is a perspective view showing the internal structure of the toner container.

Next, the detailed structure of the toner container 20 is described. FIG. 2 is a perspective view of the toner container 20 according to a first embodiment and FIG. 3 is a perspective view showing the internal structure of the toner container 20. In these figures, directions X, Y and Z are indicated. The toner container 20 roughly has a rectangular parallelepipedic shape and includes a container main body 200 with an internal space R for storing the toner, a moving shaft 30 accommodated in this internal space R, a moving plate 40 configured to move along the moving shaft 30 and film members 50, 50A and 50B (elastic member) attached to the moving plate 40. In this embodiment, a Y direction is a vertical direction and an example is shown in which the toner container 20 is assembled into an apparatus main body of the image forming apparatus 1 with a +Y side located on a lower side.

The container main body 200 includes walls defining the internal space R. The container main body 200 includes, as the walls, a first wall 21 (−Y side) and a second wall 22 (+Y side) facing each other in the Y direction (first direction), and a tubular peripheral wall 23 extending between the first and second walls 21, 22. The first wall 21 is a rectangular flat plate long in an X direction (second direction) and short in a Z direction. The second wall 22 is a flat plate slightly shorter than the first wall 21 in the X and Z directions and convex in the +Z direction.

The peripheral wall 23 includes a first side wall 231 on a +Z side, a pair of second side walls 232 facing each other in the X direction and a third side wall 234 on a −Z side, and any of these side walls is a flat plate. A supporting wall 233 is connected to a +Z side end part of each second side wall 232. The supporting wall 233 is a strip-like wall long in the Y direction and short in the X direction and perpendicular to the second side wall 232. A coupling wall 235 is connected to each of opposite end parts of the first side wall 231 in the X direction. The coupling wall 235 is a strip-like wall long in the Y direction and short in the Z direction and perpendicularly intersecting with the supporting wall 233. A width of the container main body 200 in the X direction is made smaller on the +Z than on the −Z side by step portions formed by the supporting walls 233 and the coupling walls 235. A flange portion 236 is provided on a −Y side end part of the container main body 200. The flange portion 236 has the same outer dimensions as the first wall 21 and welded to the first wall 21.

The toner discharge port 24 which penetrates through the second wall 22 in the Y direction, allows the internal space R to communicate with outside (housing of the developing device 14) and is used to supply the toner stored in the internal space R to the developing device 14 is provided near a +X side end part of the second wall 22. A plugging portion 25 is welded near a −X side end part of the second wall 22. The plugging portion 25 is a member for closing a hole through which the toner is injected into the internal space R from the outside of the container main body 200.

The moving shaft 30 is a screw shaft having rigidity and extending in the Y direction, and rotatable about an axis thereof. A −Y side end part of the moving shaft 30 is rotatably supported by a bearing portion 211 projecting on the inner surface of the first wall 21, and a +Y side end part is rotatably supported by a bearing hole provided on the second wall 22. The moving shaft 30 crosses the internal space R in the Y direction in a center of the container main body 200 in the X direction and near a center in the Z direction.

The moving shaft 30 includes a screw portion 31 (externally threaded portion) extending in the Y direction and threaded on a peripheral surface thereof, and a round bar portion 32 (idling mechanism) having no thread. The screw portion 31 takes up a most part of the moving shaft 30 excluding the vicinity of a +Y side end part. The thread of the screw portion 31 is engaged with a nut portion 41 (internally threaded portion) of the moving plate 40 to be described next. In an embodiment in which a simple engaging structure of an external thread and an internal thread is applied, the thread is a threaded groove matching an internal thread provided on the nut portion 41. On the other hand, in an embodiment in which a ball screw structure is applied, the thread is a threaded groove suitable to roll a ball. The round bar portion 32 has an outer diameter smaller than the screw portion 31 and a short one is provided near the +Y side end part of the moving shaft 30.

An end part 33 of the moving shaft 30 on the +Y side projects in the +Y direction from the second wall 22. A drive input gear 26 (drive input portion) is integrally mounted on this end part 33. A drive gear (not shown) coupled to a drive motor equipped in the apparatus main body of the image forming apparatus 1 is engaged with the drive input gear 26. A rotational drive force is given from this drive gear to the drive input gear 26, whereby the moving shaft 30 rotates about the axis thereof The moving plate 40 moves along the moving shaft 30 in the internal space R and conveys the toner in the container main body 200 toward the toner discharge port 24. In this embodiment, a moving direction of the moving plate 40 is a direction from the −Y side toward the +Y side (first direction) and a direction from top to bottom in a state assembled in the image forming apparatus 1.

Figure 4:
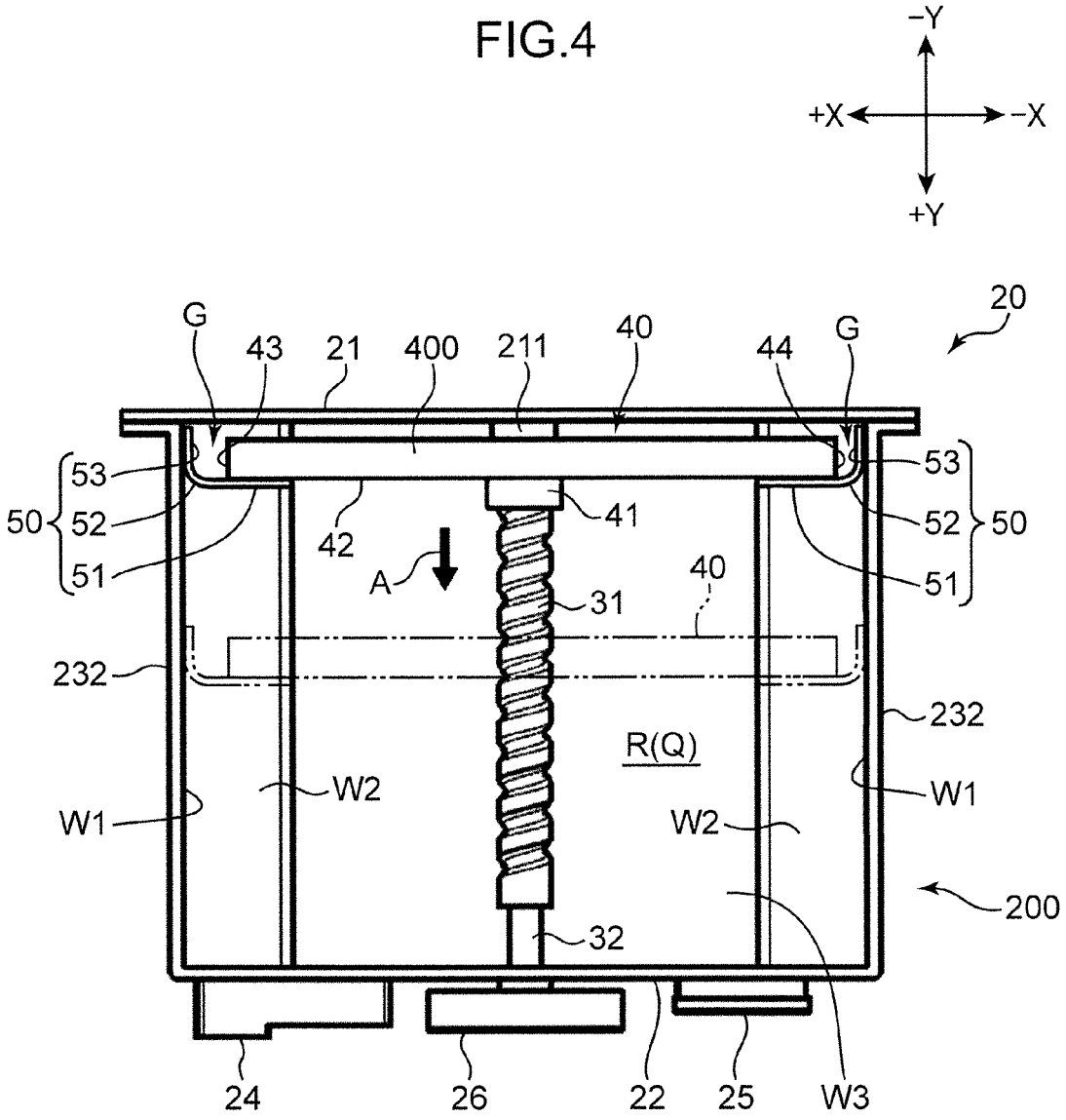
FIG. 4 is a plan view showing a moving state of a moving plate in the toner container.
Figure 5:
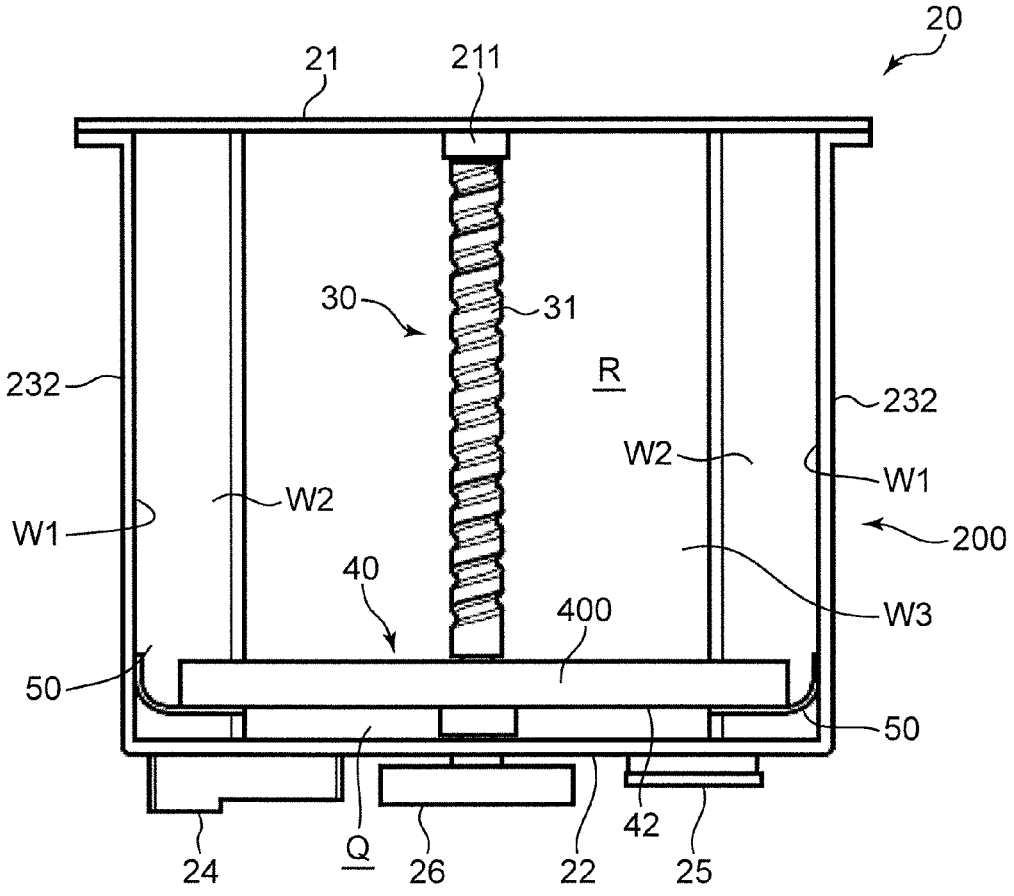
FIG. 5 is a plan view showing the moving state of the moving plate in the toner container.
Figure 6:
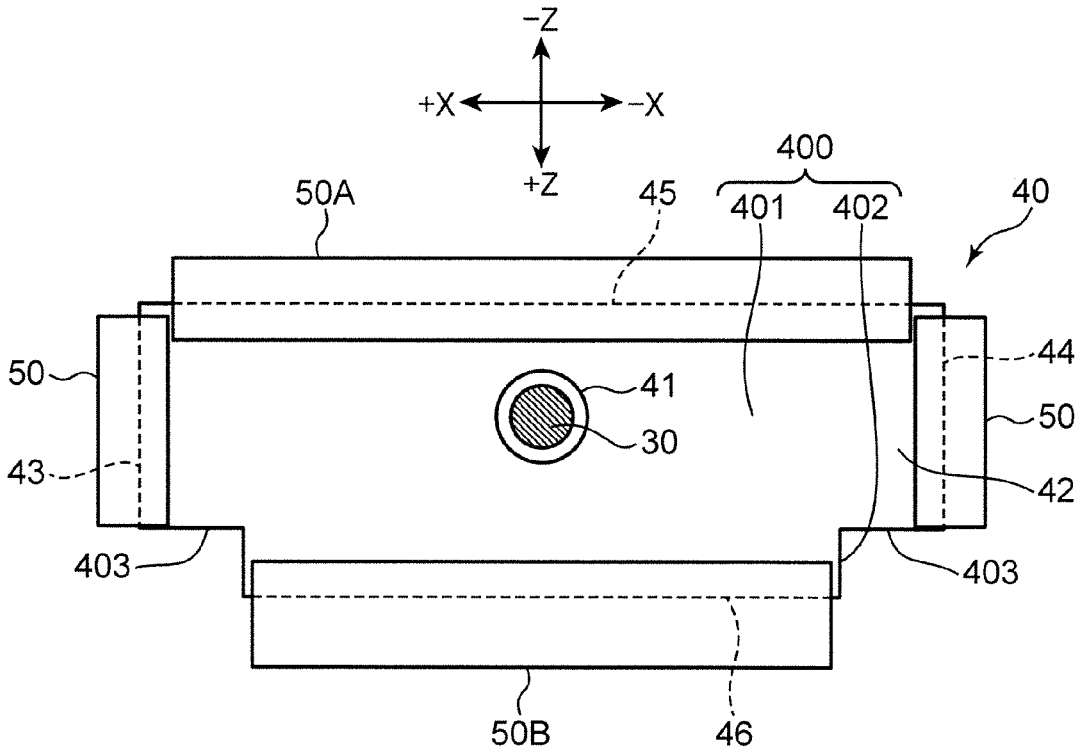
FIG. 6 is a front view of the moving plate attached with film members.

FIGS. 4 and 5 are plan views showing a moving state of the moving plate 40. FIG. 6 is a front view of the moving plate 40 attached with the film members 50, 50A and 50B. The moving plate 40 moves in a direction from the −Y side to the +Y side (downward) with the vicinity of the first wall 21 as a movement start end and the vicinity of the second wall 22 as a movement terminal end. FIG. 4 shows a state where the moving plate 40 is located at the movement start end and FIG. 5 shows a state where the moving plate 40 is located at the movement terminal end. The moving plate 40 includes a moving plate main body 400, the nut portion 41 and a pressing surface 42.

The moving plate main body 400 is a flat plate member having rigidity and has an outer shape corresponding to a cross-sectional shape of the container main body 200 in the X direction. As shown in FIG. 6, the moving plate main body 400 includes a rectangular base portion 401 long in the X direction and an extended portion 402 projecting in the +Z direction from the peripheral edge of the base portion 401 on the +Z side. The base portion 401 is accommodated between the pair of second side walls 232 of the container main body 200. A width of the base portion 401 in the X direction is somewhat shorter than a distance between inner surfaces W1 of the second side walls 232 and a width thereof in the Z direction is somewhat shorter than a length of the second side walls 232 in the Z direction. The extended portion 402 is accommodated between the pair of coupling walls 235. A width of the extended portion 402 in the X direction is slightly shorter than a distance between the inner surfaces of the coupling walls 235 and a width thereof in the Z direction is somewhat shorter than a length of the coupling walls 235 in the Z direction. The width of the extended portion 402 in the X direction is shorter than that of the base portion 401 approximately by a dimension corresponding to the pair of supporting walls 233. On the peripheral edge of the base portion 401 on the +Z side, stepped peripheral edge portions 403 on opposite ends in the X direction where the extended portion 402 does not project respectively face inner surfaces W2 of the supporting walls 233.

The nut portion 41 is integrally assembled with a central part of the base portion 401 in the X and Z directions and engaged with the moving shaft 30 (screw portion 31). An internal thread to be engaged with the thread of the screw portion 31 is formed on the inner peripheral surface of the nut portion 41. When a rotational drive force of a predetermined direction is given to the drive input gear 26, the moving shaft 30 rotates in a predetermined direction about the axis, whereby the nut portion 41 moves in the +Y direction. As a result, the moving plate 40 can move in the moving direction (lowering direction) indicated by an arrow A from the position of the movement start end of FIG. 4. A movement of the moving plate 40 is controlled by giving a predetermined amount of a rotational drive force to the drive input gear 26 at an appropriate timing according to the remaining toner amount in the container main body 200.

In a state where the toner in the container main body 200 is used up, the moving plate 40 has moved to the position of the movement terminal end of FIG. 5. In this state, the nut portion 41 has reached the round bar portion 32 of the moving shaft 30, the moving shaft 30 and the nut portion 41 are disengaged and the moving shaft 30 idly rotates with respect to the nut portion 41. Thus, at the position of the movement terminal end, a moving force is no longer transmitted from the moving shaft 30. Since the moving plate 40 can be stopped at a predetermined stop position without stopping the rotation of the moving shaft 30, it is not necessary to strictly control the rotation of the moving shaft 30 using a sensor or the like. Note that when the nut portion 41 reaches the round bar portion 32 and the nut portion 41 and the moving shaft 30 are once disengaged, the moving plate 40 cannot be returned in a direction toward the movement start end even if the moving shaft 30 is rotated in a reverse direction.

The pressing surface 42 is a flat surface which faces the second side wall 22 and actually presses the toner in the container main body 200 during the movement of the moving plate 40. In the internal space R of the container main body 200, a side surface on a −Y side of a toner storage space Q capable of substantially storing the toner is defined by the pressing surface 42. Specifically, the toner storage space Q is defined by the inner surfaces of the peripheral wall 23 and the second wall 22 and the pressing surface 42.

When the moving plate 40 is at the movement start end (FIG. 4), the pressing surface 42 is closest to the first wall 21 and most distant from the second wall 22. At this time, the internal space R and the toner storage space Q have substantially the same volume. When the toner container 20 is produced, the toner is filled into the container main body 200 through a toner filling hole located at the position of the plugging portion 25 in this state of FIG. 4. That is, the state of FIG. 4 is a state where the toner container 20 is fully filled with the toner.

When the moving plate 40 is lowered in the moving direction A as shown in dotted line in FIG. 4, the volume of the toner storage space Q relatively becomes gradually narrower with respect to the internal space R. Associated with this movement, the toner in the container main body 200 is gradually pushed toward the toner discharge port 24. When the moving plate 40 reaches the movement terminal end of FIG. 5, the pressing surface 42 and the inner surface of the second wall 22 are proximate to each other and, since the moving plate 40 and the second wall 22 are parallel flat plates, the toner storage space Q substantially disappears. As just described, the entire section from the vicinity of the first wall 21 to the vicinity of the second wall 22 serves as a moving area of the moving plate 40, where the toner can be moved toward the toner discharge port 24 while the toner storage space Q is gradually narrowed. Accordingly, all the toner in the container main body 200 can be moved toward the toner discharge port 24. Note that a paddle member for moving the toner near the inner surface of the second wall 22 toward the toner discharge port 24 is desirably provided near the +Y side end part of the moving shaft 30.

Further, in the state of FIG. 5, the pressing surface 42 substantially closes the toner discharge port 24. When the moving plate 40 reaches the movement terminal end in this way, i.e. when the toner in the container main body 200 is emptied, the moving plate 40 functions as a shutter for closing the toner discharge port 24. Further, by seeing a state where the toner discharge port 24 is closed by the moving plate 40, a user can confirm that the toner container 20 is in a toner empty state.

Since the moving plate 40 is moved by the rotation of the moving shaft 30, a rotational force about the moving shaft 30 acts to the moving plate 40 during the movement of the moving plate 40. However, the moving plate main body 400 of the moving plate 40 is shaped in conformity with the cross-sectional shape of the container main body 200 in the X direction as described above. Thus, the moving plate 40 can move in the moving direction A without rotating. The inner surfaces W2 (guide portion) of the supporting walls 233 contribute to maintaining the posture of the moving plate 40 during the movement of the moving plate 40. The rotation of the moving plate 40 is restricted by the contact of the stepped peripheral edge portions 403 with the inner surfaces W2 of the supporting walls 233, and the inner surfaces W2 guide the movement of the moving plate 40 in the moving direction A.

As shown in FIG. 6, the moving plate main body 400 includes an outer peripheral portion having a +X side peripheral edge 43, a −X side peripheral edge 44, a −Z side peripheral edge 45 and a +Z side peripheral edge 46. As described above, dimensions of the moving plate main body 400 in the X and Z directions are set somewhat shorter than those of the internal space of the container main body 200. Thus, as shown in FIGS. 3 and 4, the +X and −X side peripheral edges 43, 44 are respectively facing the inner surfaces W1 of the second side walls 232 across gaps G having a predetermined width. Although not shown, gaps are also present between the −Z side peripheral edge 45 and the inner surface of the third side wall 234 and the +Z side peripheral edge 46 and an inner surface W3 of the first side wall 231.

The film members 50, 50A and 50B are attached near the outer peripheral portion of the moving plate main body 400 to fill up the above gaps. The film members 50, 50A and 50B are flexible and function to scrape off the toner adhering to the inner surfaces by sliding in contact with the inner surfaces of the respective walls of the container main body 200 when the moving plate 40 moves in the moving direction A. PET films such as Lumirror (registered trademark of Toray Industries Inc.) films or other flexible resin films can be, for example, used as the film members 50, 50A and 50B. Alternatively, resin sponge, porous rubber members or the like may be used instead of films.

Figure 7:
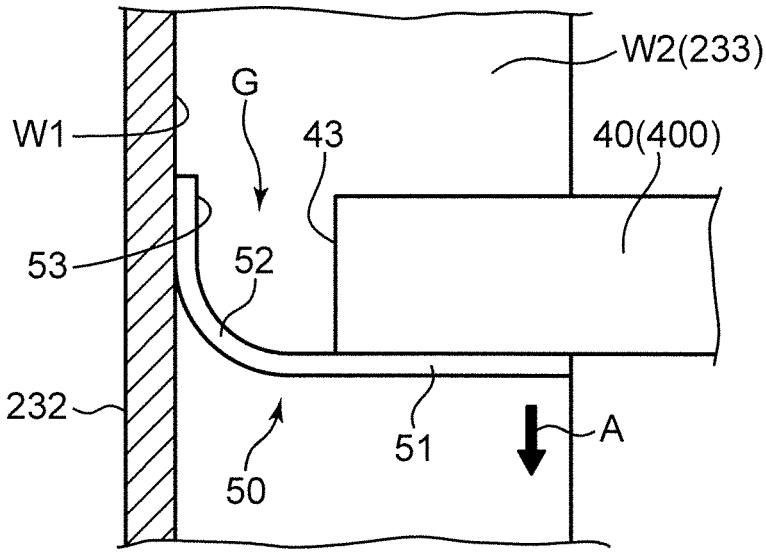
FIG. 7 is a diagram showing the action of the film member.

A pair of film members 50 are respectively attached to the moving plate main body 400 near the +X and −X side peripheral edges 43, 44. The film members 50 are rectangular films whose width in the Z direction is substantially equal to that of the base portion 401. FIG. 7 is a diagram enlargedly showing the film member 50 attached near the +X side peripheral edge 43. The film member 50 includes a base portion 51 which is attached to the moving plate main body 400 near the +X side peripheral edge 43, an intermediate portion 52 which extends across the gap G from the +X side peripheral edge 43 (outer peripheral portion) and a tip portion 53 which is held in contact with the inner surface W1 of the second side wall 232 (inner surface of the peripheral wall). The film member 50 attached near the −X side peripheral edge 44 is also similarly configured.

The base portion 51 is attached to the pressing surface 42 of the moving plate 40 via an adhesive layer made of an adhesive or a double-sided adhesive tape. Instead of the adhesive layer, an appropriate clamping member may be used and the film member 50 may be attached to the moving plate 40 by clamping the film member 50 by this clamping member and the moving plate 40. A projecting length of the film member 50 in the X direction from the +X side peripheral edge 43 is set considerably longer than the gap G. Thus, the intermediate portion 52 is curved to change a direction by 90° toward an upstream side (−Y direction) in the moving direction A. The tip portion 53 is in surface contact with the inner surface W1 of the second side wall 232 and extends in the −Y direction along this inner surface W. In this embodiment, a length of the surface contact of the tip portion 53 with the inner surface W1 in the −Y direction is set substantially equal to the width of the gap G in the X direction.

When the moving plate 40 moves in the moving direction A, the tip portions 53 of the film members 50 rub the inner surfaces W1. Toner particles adhere to the inner surfaces W1 or a toner deposition layer is formed as toner adhesion progresses. Alternatively, aggregates of the toner produced for a certain cause may adhere to the inner walls W1. The toner is scraped off as the moving plate 40 moves while the tip portions 53 of the film members 50 rub the inner surfaces W1. The scraped-off toner is stored in the toner storage space Q that gradually becomes narrower according to the movement of the moving plate 40. Thus, the toner can be effectively used without remaining on the inner surfaces W1.

The film members 50A, 50B are also similarly attached to the moving plate 40 and exhibit a similar toner scraping-off function. The film member 50A is a rectangular film having a width substantially equal to the width of the base portion 401 in the X direction, and a base end part thereof is attached to the pressing surface 42 of the moving plate 40 near the −Z side peripheral edge 45. The film member 50A includes an intermediate portion which extends across the gap between the −Z side peripheral edge 45 and the inner surface of the third side wall 234 and a tip portion which is held in contact with the inner surface of the third side wall 234.

The film member 50B is a rectangular film having a width substantially equal to the width of the extended portion 402 in the X direction, and a base end part thereof is attached to the pressing surface 42 of the moving plate 40 near the +Z side peripheral edge 46. The film member 50B includes an intermediate portion which extends across the gap between the +Z side peripheral edge 46 and the inner surface W3 of the first side wall 231 and a tip portion which is held in contact with the inner surface W3 of the first side wall 231. The film members 50A, 50B respectively function to scrape off the toner adhering to the inner surface of the third side wall 234 and the inner surface W3 of the first side wall 231 by the respective tip portions as the moving plate 40 moves in the moving direction A.

According to the toner container 20 according to the first embodiment described above, a moving path is determined since the moving plate 40 moves along the moving shaft 30. However, the gaps G are present between the outer peripheral portion (side peripheral edges 43, 44, 45 and 46) of the moving plate 40 and the inner surfaces of the peripheral wall 23 and the film members 50, 50A and 50B move while sliding in contact with the inner surfaces of the peripheral wall 23. Thus, the posture of the moving plate 40 tends to be unstable. However, the posture of the moving plate 40 is maintained as in an initial state by guiding the stepped peripheral edge portions 403 of the moving plate main body 400 by the inner surfaces W2 of the supporting walls 233. Therefore, the moving plate 40 can stably move in the moving direction A and the toner in the container main body 200 can be reliably moved toward the toner discharge port 24.

Further, the gaps G are present between the outer peripheral portion of the moving plate 40 and the inner surfaces W1, W3 of the peripheral wall 23 and only the tip portions 53 of the film members 50, 50A and 50B slide in contact with the inner surfaces W1, W3 of the peripheral wall 23 excluding guide areas on the inner surfaces W2. Thus, movement resistance in moving the moving plate 40 in the moving direction A can be reduced. Further, since the gaps G are provided, dimensional accuracy can be loosely set for the inner surfaces W1, W3 of the peripheral wall 23 of the moving plate 40. That is, it is not necessary to strictly control dimensions in fabricating the moving plate 40, wherefore a cost reduction can be realized.

Figure 8:
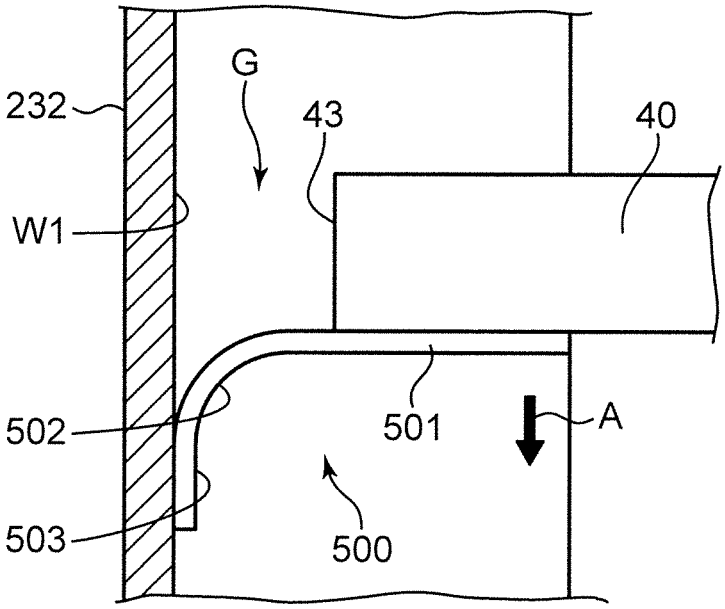
FIG. 8 is a diagram showing the action of the film member.

FIG. 8 is a diagram showing an attached state of a film member 500 according to a modification. The film member 500 includes a base portion 501 which is attached to the moving plate 40 near the +X side peripheral edge 43, an intermediate portion 502 which extends across the gap G from the +X side peripheral edge 43 and a tip portion 503 which is held in contact with the inner surface W1 of the second side wall 232. What is different from the embodiment of FIG. 7 is a curved direction of the intermediate portion 502. The intermediate portion 502 is curved to change a direction by 90° toward a downstream side (+Y direction) in the moving direction A. The tip portion 503 extends in the +Y direction along the inner surface W1 of the second side wall 232.

With the film member 500 according to the modification, the end edge of the tip portion 503 comes into contact with the inner surface W1 in a counter direction when the moving plate 40 moves in the moving direction A. That is, the end edge of the tip portion 503 moves to scrape off the toner adhering to the inner surface W1. Accordingly, a property of scraping off the toner on the inner surface W1 can be enhanced. Note that a material having appropriate stiffness is desirably selected for the film member 500 to prevent buckling during the movement of the moving plate 40. According to this modification, a space corresponding to a bending margin on the upstream side in the moving direction A of the film member 50 as shown in FIG. 3 is not necessary. Thus, the moving plate 40 can be closer to the first wall 21 at the movement start end and a dead space where the toner cannot be stored can be minimized.

Figure 9:
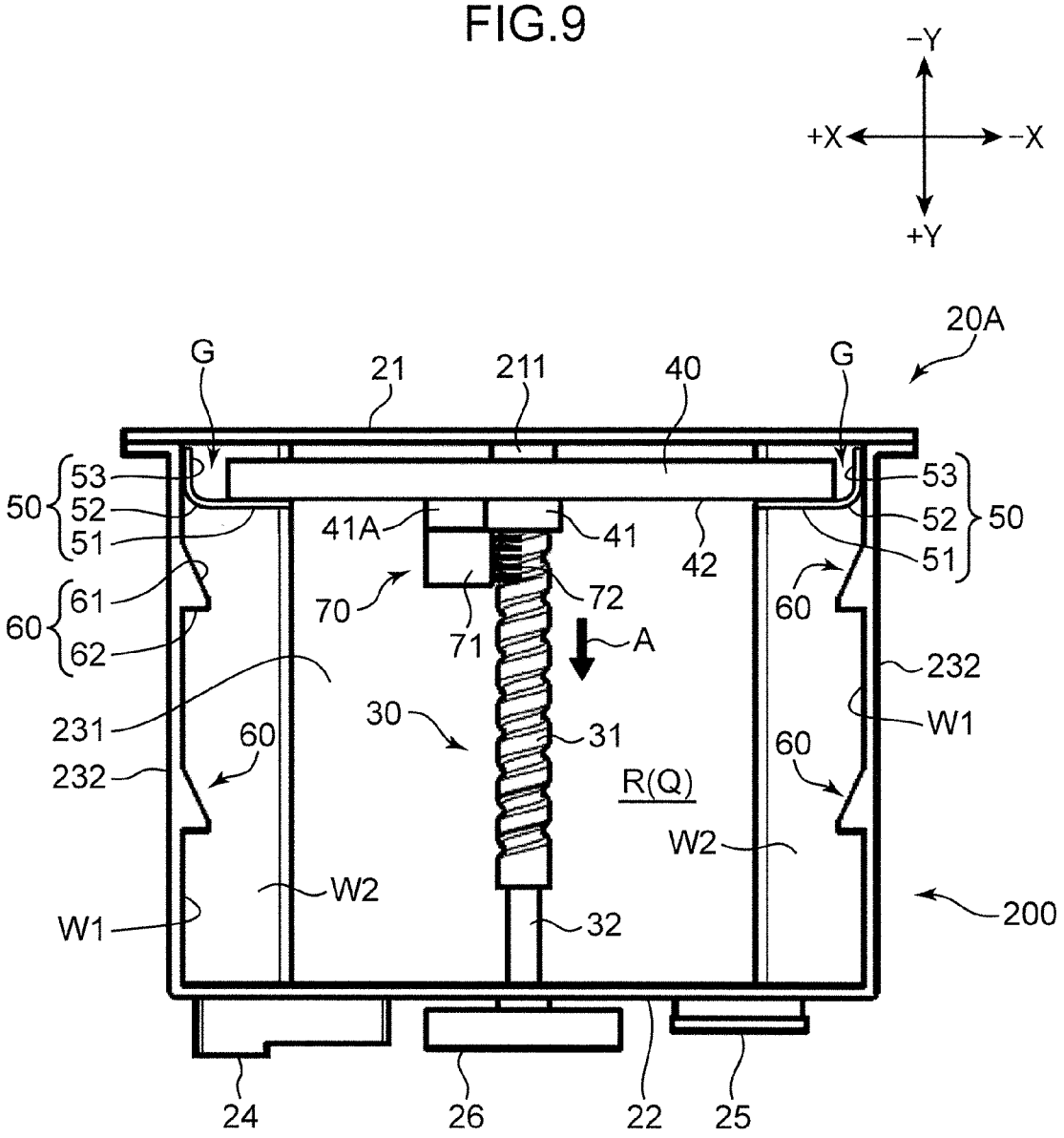
FIG. 9 is a plan view of a toner container according to a second embodiment of the present disclosure.

Next, FIG. 9 is a perspective view showing the internal structure of a toner container 20A according to a second embodiment. The toner container 20A differs from the toner container 20 of the first embodiment in that projections 60 project on the inner surfaces W1 of the second side walls 232 and the moving plate 40 is equipped with a cleaning member 70 for cleaning the peripheral surface of the moving shaft 30. The following description is centered on these points.

The projections 60 project toward the internal space R in areas of the inner surfaces W1 of the second side walls 232 where the film members 50 slide in contact. In this embodiment, two projections 60 are provided on each of the second side walls 232 on the +X and −X sides while being spaced apart in the Y direction. While the moving plate 40 moves in the moving direction A (first direction) from the movement start end toward the movement terminal end, the film member 50 interferes with the two projections 60. Since the film member 50 is struck by this interference, the film member 50 can be caused to scrape off the toner adhering to the inner surface W1 by the backlash of the film member 50.

A maximum projecting height of each projection 60 is set to be accommodated within the range of the gap G. The projection 60 has a right triangular shape when viewed in the Z direction. Specifically, the projection 60 includes an inclined portion 61 whose projecting height gradually increases from an upstream side toward a downstream side in the moving direction A, and a step portion 62 whose projecting height is suddenly reduced from a part of the inclined portion 61 with a maximum projecting height. The step portion 62 is a part perpendicular to the inner surface W1. Since the projection 60 has such a shape, an elastic force of the film member 50 can gradually increase as the film member 50 climbs up the inclined portion 61 and can be released at once the moment the step portion 62 is reached. Thus, a force of scraping off the toner from the inner surface W1 can be increased.

Note that although not shown in FIG. 9, one or more projections similar to the aforementioned projections 60 are preferably provided on each of the first and third side walls 231, 234 of the peripheral wall 23. This enables also the film members 50A, 50B to exhibit a toner scraping-off force by the above elastic force.

Figure 10:
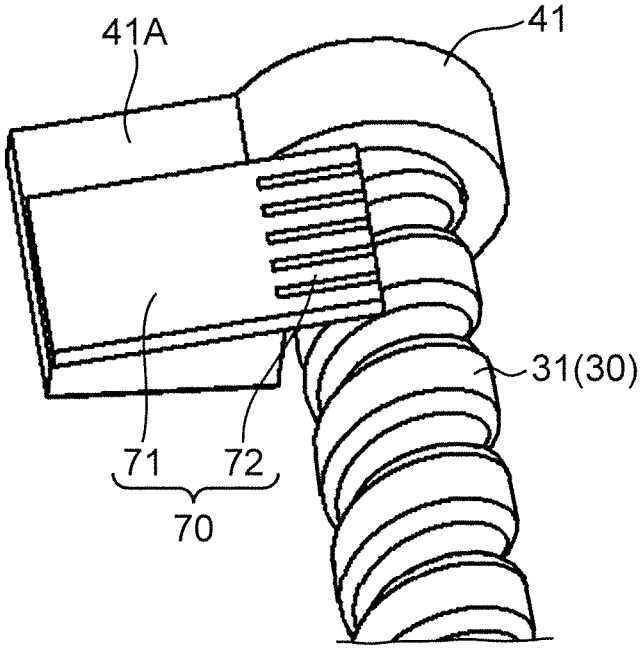
FIG. 10 is a perspective view enlargedly showing a cleaning member.

The cleaning member 70 is integrally assembled with the moving plate 40 and arranged at a position to come into contact with the peripheral surface of the moving shaft 30 at a side downstream of the moving plate 40 in the moving direction A. FIG. 10 is a perspective view enlargedly showing the cleaning member 70. The cleaning member 70 is a member in the form of a thin plate and includes a base part 71 made of a flat plate and a brush part 72 formed by providing a plurality of slits on a flat plate. The moving shaft 30 is arranged across the internal space R (toner storage space Q) of the container main body 200. Thus, the toner adheres to the peripheral surface of the moving shaft 30. If the toner deposits or is fixed in the screw groove of the screw portion 31, it may not be possible for the nut portion 41 to move on the screw portion 31. The cleaning member 70 cleans the peripheral surface of the moving shaft 30, particularly the peripheral surface of the screw portion 31, so that such a problem does not occur.

The base part 71 is a part corresponding to the base of the brush part 72. In this embodiment, an expended portion 41A extending from the outer periphery of the nut portion 41 and configured to support the base part 71 is integrally provided to the nut portion 41. The extended portion 41A has a holding flat surface and the underside of the base part 71 is bonded to the holding flat surface. The brush part 72 is in contact with the peripheral surface of the screw portion 31 (moving shaft 30) with a predetermined pressing force. Brush pieces of the brush part 72 are arranged in the Y direction. Although only simply shown in FIG. 10, some brush pieces are in contact with screw groove parts of the screw portion 31 and the other brush pieces are in contact with screw thread parts.

Figure 11A:
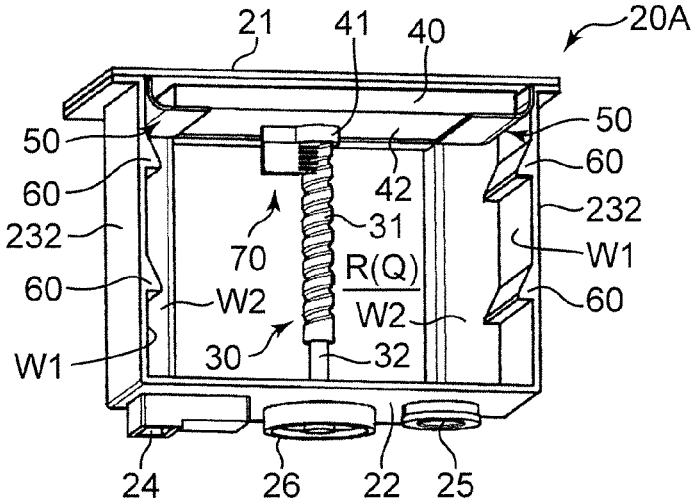
FIGS. 11A, 11B and 11C are plan views showing a moving state of a moving plate in a toner container according to the second embodiment.
Figure 11B:
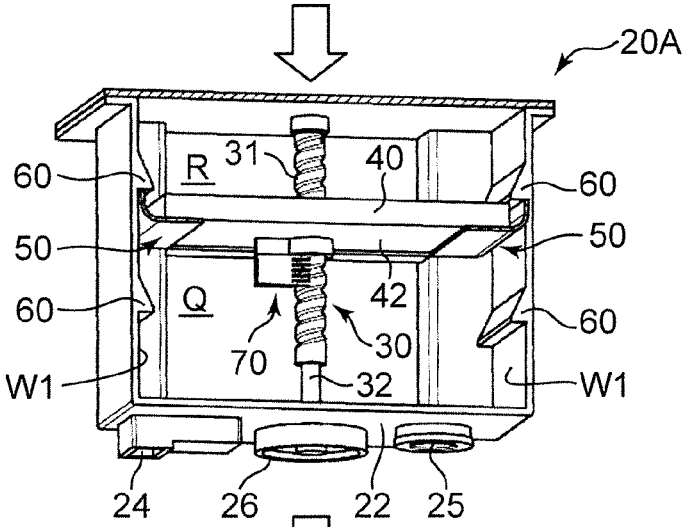
Figure 11C:
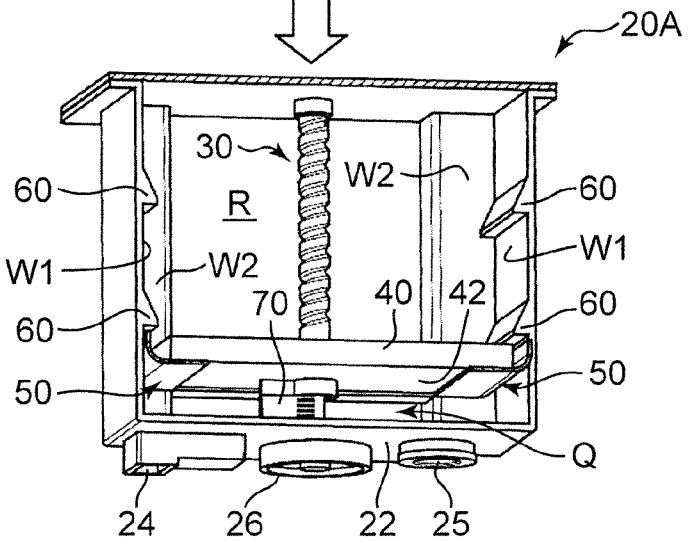

FIGS. 11A, 11B and 11C are plan views showing a moving state of the moving plate 40 in the toner container 20A according to the second embodiment. FIG. 11A shows a state where the moving plate 40 is located at the movement start end, FIG. 11B shows a state where the moving plate 40 having moved to a certain extent is located at an intermediate position and FIG. 11C shows a state where the moving plate 40 is located at the movement terminal end. As the moving plate 40 moves, the toner storage space Q gradually becomes narrower in the internal space R of the container main body 200 and the toner is guided toward the second wall 22 formed with the toner discharge port 24. This point is the same as in the first embodiment.

As the moving plate 40 moves, the cleaning member 70 also moves. The cleaning member 70 is arranged on a side downstream of the nut portion 41 in the moving direction A. Thus, the peripheral surface of the screw portion 31 immediately downstream of a part to be passed by the nut portion 41 by the rotation of the moving shaft 30 is cleaned in advance by the cleaning member 70. That is, the moving plate 40 can be moved in the moving direction A while the toner adhering to the peripheral surface of the screw portion 31 is removed before the nut portion 41 comes into contact with the toner. Thus, a smooth movement of the moving plate 40 can be ensured.

Figure 12A:
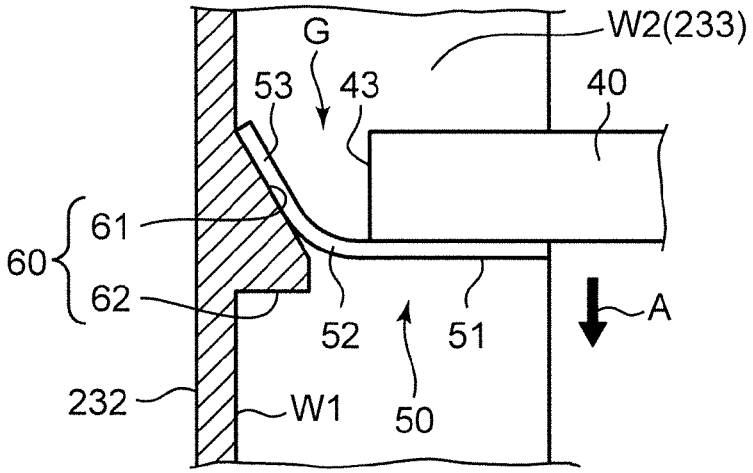
FIGS. 12A, 12B and 12C are diagrams successively showing a state of a film member moving over a projection.
Figure 12B:
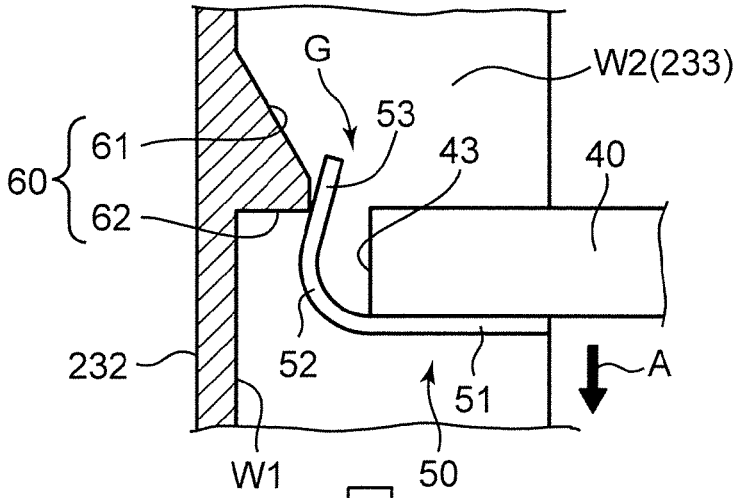
Figure 12C:
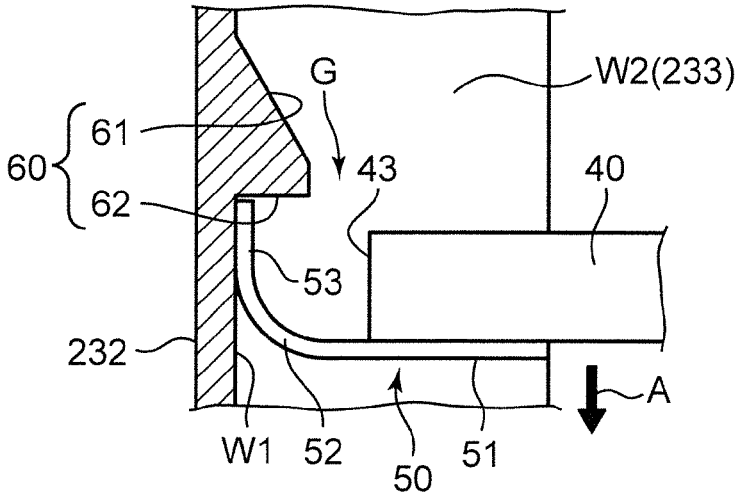

Further, FIG. 11B shows a state immediately after the film members 50 pass over the upstream projections 60 and FIG. 11C shows a state immediately after the film members 50 pass over the downstream projections 60. FIGS. 12A, 12B and 12C are diagrams successively showing a state of the film member 50 moving over the projection 60.

As shown in FIG. 12A, the tip portion 53 of the film member 50 slides in contact with the inclined portion 61 in an initial stage of the passage of the film member 50 over the projection 60. Since the inclined portion 61 is raised in a direction toward the moving shaft 30 from the inner surface W1, a degree of curvature of the intermediate portion 52 gradually increases as the moving plate 40 moves in the moving direction A. That is, the elastic force of the film member 50 gradually increases. FIG. 12B shows a state immediately before the tip portion 53 passes over a maximum projecting height part of the inclined portion 61. In this state, the degree of curvature of the intermediate portion 52 further increases and the elastic force accumulated in the film member 50 is increased to a maximum level.

FIG. 12C shows a moment at which the tip portion 53 reaches the step portion 62 by a further movement of the moving plate 40 in the moving direction A and the elastic force of the film member 50 is suddenly released. At this time, the tip portion 53 strikes the inner surface W1 and an air flow is also generated. By this striking movement and wind pressure, the toner adhering to the struck part of the inner surface W1 and a part downstream of the struck part is scraped off from the inner surface W1. Thus, the toner can be more effectively scraped off from the inner surface W1 as compared with the case where the film member 50 simply rubs the inner surface W1.

The toner containers 20, 20A according to the embodiments of the present disclosure and the image forming apparatus 1 provided with these have been described above, but the present disclosure is not limited to these. The present disclosure can be, for example, modified as follows.

(1) In the above embodiment, the toner container 20 is assembled into the apparatus main body of the image forming apparatus 1 with the +Y side located on the lower side. Instead of this, the toner container 20 may be assembled into the apparatus main body of the image forming apparatus 1 with the Y direction, i.e. the extending direction of the moving shaft 30 as a horizontal direction. In this case, the toner discharge port 24 is arranged near the second wall 22 on the lower surface of the peripheral wall 23.

(2) In the above embodiments, the round bar portion 32 is provided near the downstream end of the moving shaft 30 and the mechanism for idly rotating the nut portion 41 when the moving plate 40 reaches the movement terminal end is applied. The round bar portion 32 is one example of the idling mechanism. For example, the nut portion 41 may be idly rotated with respect to the moving shaft 30 by being equipped with a one-way clutch or the like. Further, a sensor for detecting the position of the moving plate 40 may be provided and the rotational drive of the moving shaft 30 may be controlled based on a detection result of this sensor.

(3) In the above embodiments, the inner surfaces W2 of the supporting walls 233 are used as the guide portion for the moving plate 40. The guide portion has only to be able to move the moving plate 40 while maintaining the posture of the moving plate 40. For example, a guide groove and a guide projection to be engaged with this guide groove may be respectively provided on the outer peripheral portion of the moving plate 40 and the inner surface of the peripheral wall 23.

(4) In the above embodiment, the cleaning member 70 is made of a flat plate including slits. Instead of this, the cleaning member 70 used may be made of an easily deformable member, e.g. a flexible film. Such a cleaning member 70 does not prevent a movement of the moving plate 40 in the +Y direction after the cleaning member 70 reaches the second wall 22. Finally, the cleaning member 70 is squeezed (compressed) between the pressing surface 42 of the moving plate 40 and the second wall 22. Thus, there are advantages that the pressing surface 42 can substantially close the toner discharge port 24 and the toner can be used up (the storage space Q can be minimized at the end).

According to the present disclosure as described above, it is possible to provide a developer storage container in which a developer is left in a container main body as little as possible and an image forming apparatus provided with the same.

The invention claimed is:

1. A developer storage container, comprising:

a container main body with a wall defining an internal space for storing a developer, the wall of the container main body including a first wall and a second wall facing each other in a first direction and a tubular peripheral wall extending between the first and second walls, the peripheral wall including a step portion formed by a partially different width in a second direction perpendicular to the first direction;

a developer discharge port arranged at a predetermined position of the container main body and allowing the internal space to communicate with outside through the wall;

a moving shaft arranged to extend in the first direction in the internal space;

a moving plate configured to move in the first direction along the moving shaft in the internal space and to convey the developer toward the developer discharge port, the moving plate including an outer peripheral portion facing an inner wall of the peripheral wall across a gap;

a guide portion configured to guide a movement of the moving plate in the first direction while maintaining the posture of the moving plate; and an elastic member attached to the moving plate and configured to slide in contact with an inner surface of the wall of the container main body when the moving plate moves in the first direction, the elastic member being made of a flexible film member that includes a base portion attached to the moving plate, an intermediate portion that extends across the gap from the outer peripheral portion and a tip portion that is held in contact with the inner surface of the peripheral wall, wherein:

the guide portion is an inner surface of the step portion and the moving plate is guided by contact of a part of the moving plate with the inner surface.

2. A developer storage container according to claim 1, wherein:

the developer discharge port is arranged on the second wall or the peripheral wall near the second wall;

the moving plate moves in the first direction with the vicinity of the first wall as a movement start end and the vicinity of the second wall as a movement terminal end and includes a pressing surface facing the second wall; and the pressing surface gradually narrows a storage space for storing the developer in the internal space by a movement of the moving plate from the movement start end toward the movement terminal end.

3. A developer storage container according to claim 2, wherein:

the second wall is a flat plate, the pressing surface is a flat surface extending in a second direction perpendicular to the first direction and the developer discharge port is arranged on the second wall; and the pressing surface substantially closes the developer discharge port when the moving plate reaches the movement terminal end.

4. A developer storage container according to claim 1, wherein:

the peripheral wall includes a first part having a first length in the second direction perpendicular to the first direction, a second part having a second length shorter than the first length and a supporting wall as the step portion coupling the first part and the second part;

the moving plate includes a base portion to be accommodated in the first part and an extended portion projecting from one peripheral edge of the base portion and to be accommodated in the second part, and a stepped peripheral edge portion is formed on the one peripheral edge due to the extended portion having a shorter width in the second direction than the base portion; and the inner surface is an inner surface of the supporting wall and the moving plate is guided by the contact of the stepped peripheral edge portion with the inner surface.

5. A developer storage container, comprising:

a container main body with a wall defining an internal space for storing a developer;

a developer discharge port arranged at a predetermined position of the container main body and allowing the internal space to communicate with outside through the wall;

a moving shaft arranged to extend in a first direction in the internal space;

a moving plate configured to move in the first direction along the moving shaft in the internal space and convey the developer toward the developer discharge port;

a guide portion configured to guide a movement of the moving plate in the first direction while maintaining the posture of the moving plate; and an elastic member attached to the moving plate and configured to slide in contact with an inner surface of the wall of the container main body when the moving plate moves in the first direction, wherein:

the wall of the container main body includes a first wall and a second wall facing each other in the first direction and a tubular peripheral wall extending between the first and second walls;

the moving plate moves in the first direction with the vicinity of the first wall as a movement start end and the vicinity of the second wall as a movement terminal end and includes a pressing surface facing the second wall;

the second wall is a flat plate, the pressing surface is a flat surface extending in a second direction perpendicular to the first direction and the developer discharge port is arranged on the second wall; and the pressing surface substantially closes the developer discharge port when the moving plate reaches the movement terminal end.

6. A developer storage container according to claim 5, wherein:

a developer storage space capable of storing the developer is defined by inner surfaces of the peripheral wall and the second wall and the pressing surface in the internal space;

the pressing surface gradually narrows the developer storage space by a movement of the moving plate from the movement start end toward the movement terminal end; and the developer storage space substantially disappears when the moving plate reaches the movement terminal end.

7. A developer storage container according to claim 5, wherein:

the container main body includes a projection projecting toward the internal space in an area of an inner surface of the wall where the elastic member slides in contact.

8. A developer storage container according to claim 7, wherein:

the projection has a maximum projecting height to be accommodated in the gap and includes an inclined portion whose projecting height gradually increases from an upstream side toward a downstream side in the first direction and a step portion whose projecting height is suddenly reduced from a part of the inclined portion with the maximum projecting height.

9. An image forming apparatus, comprising:

a developer storage space according to claim 5;

an image carrier that carries an electrostatic latent image and a developer image;

a developing device to which the developer is supplied from the developer storage container and which supplies the developer to the image carrier; and a transfer unit that transfers the developer image from the image carrier to a sheet.

10. A developer storage container according to claim 5, wherein:

the moving plate includes an outer peripheral portion facing an inner wall of the peripheral wall across a gap;

the elastic member is made of a flexible film member; and the film member includes a base portion that is attached to the movable plate, an intermediate portion that extends across the gap from the outer peripheral portion and a tip portion that is held in contact with the inner surface of the peripheral wall.

11. A developer storage container, comprising:

a container main body with a wall defining an internal space for storing a developer;

a developer discharge port arranged at a predetermined position of the container main body and allowing the internal space to communicate with outside through the wall;

a moving shaft arranged to extend in a first direction in the internal space, the moving shaft including an externally threaded portion on a peripheral surface thereof and a drive input portion to which a rotational drive force is given from outside for rotating the moving shaft about an axis;

a moving plate configured to move in the first direction along the moving shaft in the internal space and to convey the developer toward the developer discharge port, the moving plate integrally including an internally threaded portion to be engaged with the externally threaded portion so that the moving plate is moved in the first direction by the rotational drive force that rotates the moving shaft about the axis;

a guide portion configured to guide a movement of the moving plate in the first direction while maintaining the posture of the moving plate;

an elastic member attached to the moving plate and configured to slide in contact with an inner surface of the wall of the container main body when the moving plate moves in the first direction; and an idling mechanism provided at a position of the moving shaft where the movement of the moving plate along the moving shaft is stopped and configured to idly rotate the moving shaft with respect to the internally threaded portion.

12. A developer storage container, comprising:

a container main body with a wall defining an internal space for storing a developer;

a developer discharge port arranged at a predetermined position of the container main body and allowing the internal space to communicate with outside through the wall;

a moving shaft arranged to extend in a first direction in the internal space, the moving shaft including an externally threaded portion on a peripheral surface thereof and a drive input portion to which a rotational drive force is given from outside for rotating the moving shaft about an axis;

a moving plate configured to move in the first direction along the moving shaft in the internal space and to convey the developer toward the developer discharge port, the moving plate integrally including an internally threaded portion to be engaged with the externally threaded portion so that the moving plate is moved in the first direction by the rotational drive force that rotates the moving shaft about the axis;

a guide portion configured to guide a movement of the moving plate in the first direction while maintaining the posture of the moving plate;

an elastic member attached to the moving plate and configured to slide in contact with an inner surface of the wall of the container main body when the moving plate moves in the first direction; and a cleaning member integrally assembled with the moving plate and configured to come into contact with a peripheral surface of the externally threaded portion on a downstream side of the moving plate in the first direction, the cleaning member being made of an easily deformable member; wherein the moving plate moves in the first direction with the vicinity of the first wall as a movement start end and the vicinity of the second wall as a movement terminal end and includes a pressing surface facing the second wall; and the cleaning member is squeezed between the pressing surface and the second wall when the moving plate reaches the movement terminal end.

13. A developer storage container, comprising:

a container main body with a wall defining an internal space for storing a developer;

a developer discharge port arranged at a predetermined position of the container main body and allowing the internal space to communicate with outside through the wall;

a moving shaft arranged to extend in a first direction in the internal space and including an externally threaded portion on a peripheral surface thereof;

a moving plate integrally including an internally threaded portion to be engaged with the externally threaded portion so that rotation of the moving shaft about an axis moves the moving plate in the first direction along the moving shaft in the internal space to convey the developer toward the developer discharge port, the internally threaded portion including a nut portion and an extended portion extending from the outer periphery of the nut portion, the extended portion having a holding flat surface extending farther downward than the nut portion in the first direction;

a guide portion configured to guide a movement of the moving plate in the first direction while maintaining the posture of the moving plate;

an elastic member attached to the moving plate and configured to slide in contact with an inner surface of the wall of the container main body when the moving plate moves in the first direction; and a cleaning member integrally assembled with the moving plate and configured to come into contact with a peripheral surface of the externally threaded portion on a side downstream of the moving plate in the first direction, and the cleaning member cleans the peripheral surface of the externally threaded portion in advance before the internally threaded portion comes into contact with the externally threaded portion, the cleaning member is in the form of a thin plate and partly held on the holding flat surface.

14. A developer storage container according to claim 13, wherein:

the cleaning member includes a base part made of a flat plate and a brush part connected to the base part and configured to come into contact with the peripheral surface of the externally threaded portion; and the base part is held on the holding flat surface of the extended portion so that the brush part is adjacent to and downstream of the nut portion in the first direction.

* * * * *